US005800062A

United States Patent [19]

Tobolka

[11] Patent Number: 5,800,062

[45] Date of Patent: Sep. 1, 1998

[54] CONTAINER AND METHOD OF MAKING THE SAME

[75] Inventor: Stefan Tobolka, Ingelwood, Canada

[73] Assignee: Arkmount Systems, Inc., Toronto, Canada

[21] Appl. No.: 771,166

[22] Filed: Dec. 20, 1996

Related U.S. Application Data

[62] Division of Ser. No. 563,951, Nov. 29, 1995.

[51] Int. Cl.[6] ..... B65D 31/00; B65D 33/00

[52] U.S. Cl. ..... 383/104; 222/212; 222/572; 383/906; 493/87

[58] Field of Search ..... 383/906, 104; 222/212, 213, 214, 206, 572, 566; 493/87; 53/133.2, 133.1

[56] References Cited

U.S. PATENT DOCUMENTS

| | | | |
|---|---|---|---|
| 2,554,050 | 5/1951 | Neubeck | 222/23 |
| 2,866,488 | 12/1958 | Thompson | 383/906 X |
| 2,950,029 | 8/1960 | Winstead | 383/906 X |
| 2,999,627 | 9/1961 | Reinhardt | 229/53 |
| 3,009,498 | 11/1961 | Fohr | 150/9 |
| 3,325,961 | 6/1967 | Lindh | 53/451 X |
| 3,367,380 | 2/1968 | Dickey | 383/906 X |
| 3,387,701 | 6/1968 | Schneider | 206/46 |
| 3,502,521 | 3/1970 | Doyen | 156/69 |
| 3,795,359 | 3/1974 | Rausing | 229/7 R |
| 4,041,851 | 8/1977 | Jentsch | 93/35 |
| 4,294,362 | 10/1981 | Martensson | 206/622 |
| 4,314,558 | 2/1982 | Korpman | 206/265 X |
| 4,361,235 | 11/1982 | Gautier | 206/527 |
| 4,580,392 | 4/1986 | Lagerstedt et al. | 53/451 |
| 4,718,778 | 1/1988 | Ichikawa | 383/100 |
| 4,747,253 | 5/1988 | Schulte | 53/433 |
| 4,848,063 | 7/1989 | Niske | 53/451 |
| 4,911,563 | 3/1990 | Ciani | 383/89 |
| 4,935,283 | 6/1990 | Jamison | 428/174 |
| 4,974,732 | 12/1990 | Sullivan et al. | 206/610 |
| 5,018,646 | 5/1991 | Billman et al. | 222/107 |
| 5,054,631 | 10/1991 | Robbins, III | 220/666 X |
| 5,228,782 | 7/1993 | Imer | 383/200 |
| 5,333,758 | 8/1994 | Jamison et al. | 222/101 |
| 5,378,065 | 1/1995 | Tobolka | 383/906 X |

FOREIGN PATENT DOCUMENTS

| | | |
|---|---|---|
| 33991 | 12/1964 | Finland . |
| 2176605 | 11/1973 | France . |
| 77838 | 3/1993 | Japan . |
| 978901 | 1/1965 | United Kingdom . |
| 9008704 | 8/1990 | WIPO . |

*Primary Examiner*—James F. Coan
*Attorney, Agent, or Firm*—Baker & Daniels

[57] ABSTRACT

A container for liquids such as beverages and the like is formed of flexible material such as plastic and includes a body having an internal reservoir and a tubular spout extending upwardly from the body. The spout has an internal passage in fluid communication with the reservoir. A constriction in the container creates a low pressure zone in the passage downstream of the constriction as liquid flows from the reservoir into the spout. Means are also provided to inflate the spout as liquid flows along the passage. A method of forming a self-supporting liquid filled container is also disclosed.

25 Claims, 8 Drawing Sheets

CONTAINER AND METHOD OF MAKING THE SAME

This is a division of application Ser. No. 08/563,951, filed Nov. 29, 1995.

FIELD OF THE INVENTION

The present invention relates to containers and in particular to a container adapted to hold a liquid such as a beverage or the like. The present invention also relates to a method of forming a self-supporting liquid-filled container.

BACKGROUND OF THE INVENTION

Containers to hold liquids such as beverages are well known in the art. One such known beverage container, commonly referred to as a Tetra-Pak™, includes a generally rectangular body formed of layers of laminated material. At the top of the body is a foil or plastic covered aperture through which a straw or the like may by pushed to allow an individual to drink the contents of the container. Although these containers are widely used, their design does not make them readily recyclable and after use, they are typically disposed of through landfill.

An alternative container design is disclosed in U.S. Pat. No. 5,378,065 to Tobolka. This container is formed of a unitary piece of plastic material folded and bonded at appropriate locations to define a body having an internal reservoir and an integrally formed spout. The spout extends upwardly from the body of the container and defines a straw to allow an individual to drink the contents of the container. A restriction in the container is positioned at the juncture between the body of the container and the spout to reduce the pressure of liquid flowing from the body to the spout. This gives the individual more control over the velocity of the out-flowing liquid.

Although this container is satisfactory, improved container designs are continually being sought. It is therefore an object of the present invention to provide a novel container for liquids such as beverages or the like. It is also an object of the present invention to provide a novel method of forming a self-supporting liquid-filled container.

SUMMARY OF THE INVENTION

According to one aspect of the present invention there is provided a container for liquids formed of flexible material comprising:

- a body having an internal reservoir;
- a tubular spout extending from said body and having an internal passage in fluid communication with said reservoir;
- a constriction in said container to create a low pressure zone in said passage downstream of said constriction as liquid flows from said reservoir into said passage; and
- means to inflate said spout as liquid flows along said passage.

Preferably the container is formed from a unitary piece of plastic material. It is also preferred that the constriction is defined by at least one projection on an internal wall of the spout which extends into the internal passage. In one embodiment, the constriction is defined by a pair of diametrically opposed projections on the internal wall. In another embodiment, the constriction is defined by an obstruction extending across the passage which resembles an inverted wing.

According to another aspect of the present invention there is provided a method of forming a self-supporting liquid filled container in the form of a pouch formed from a unitary sheet of plastic material folded and bonded at appropriate locations and filled with a liquid, said method comprising the steps of:

- pinching opposed bottom corners of said pouch to form generally flattened triangular portions extending outwardly therefrom; and
- forming seals along the pinch lines to create a generally planar base on said pouch.

According to yet another aspect of the present invention there is provided a method of forming a liquid-filled container from a tube formed of flexible material comprising the steps of:

- forming a first transverse seal across said tube;
- filling at least a portion of said tube above said first seal with liquid;
- forming a second transverse seal across said tube above and spaced from said first seal, said first and second seals constituting sides of said container and being configured to define a body having an internal reservoir and a spout in fluid communication with said reservoir extending from said body; and
- separating said container from said tube.

The present invention provides advantages in that the constriction reduces the pressure of liquid flowing from the reservoir into the spout giving an individual more control over the velocity of out-flowing liquid while the gradual tapering of the spout ensures that the spout generally fully inflates as liquid flows along the spout. Also, the design of the container is such that the container can be formed from a plastic tube after the tube has been filled with liquid while minimizing material waste. Also, the container can be made self-supporting after having been filled with liquid.

BRIEF DESCRIPTION OF THE DRAWINGS

Embodiments of the present invention will now be described more fully with reference to the accompanying drawings in which.

DESCRIPTION OF THE PREFERRED EMBODIMENTS

Figure 1A:
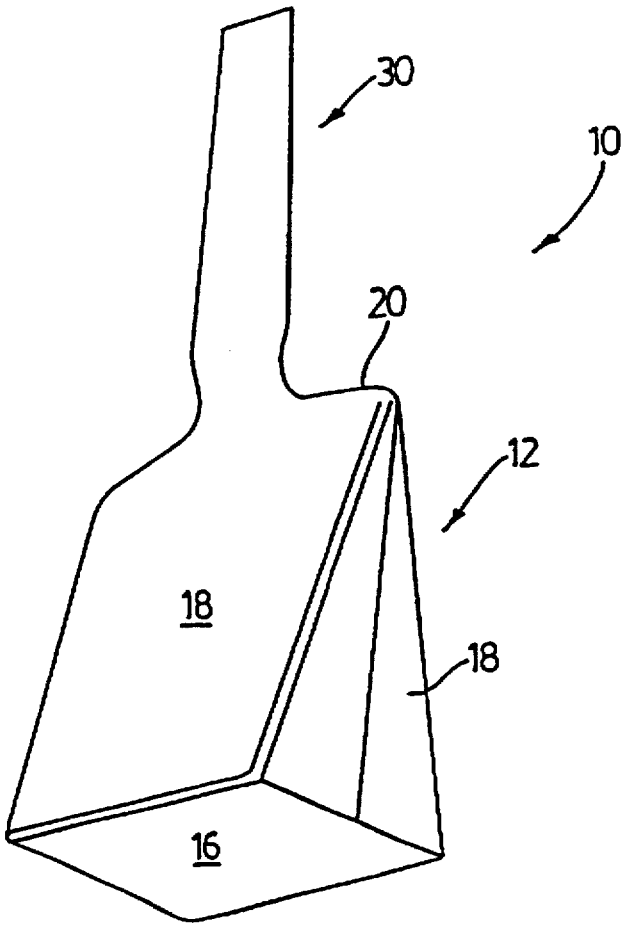
FIGS. 1*a* and 1*b* are perspective and cross-sectional views of an embodiment of a self-supporting container for liquids.
Figure 1B:
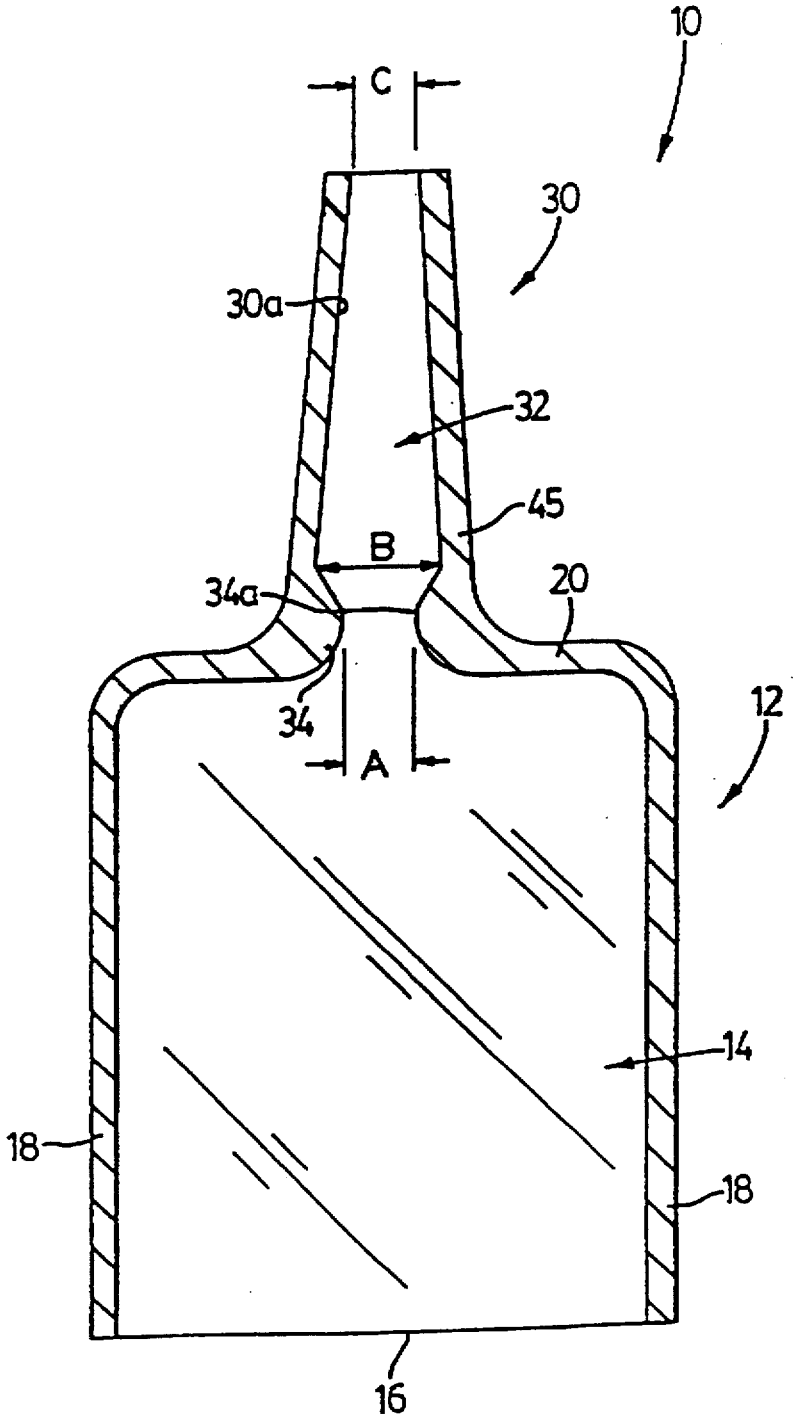

Referring now to FIGS. 1*a* and 1*b*, an embodiment of a self-supporting container for liquids such as beverages or the like is shown and is generally indicated by reference numeral 10. The container 10 is formed of any suitable generally light weight, flexible material. For example, the container 10 may be formed from any suitable plastic material such as for example, polyethylene, polypropylene or polyvinyl chloride. If desired, the plastic material may be coated with a leak inhibiting material such as for example $SiO_2$. Alternatively, the container 10 may be formed of other material such as aluminum foil or an aluminum sprayed film.

In the preferred embodiment, the container 10 is formed from a sheet of plastic film (either coated or uncoated) which has been folded and bonded at appropriate locations. As can be seen, container 10 has a hollow, generally rectangular parallelepiped main body 12 defining an internal reservoir 14 for holding liquid. The main body 12 has a generally rectangular base 16, generally upright sidewalls 18 about the periphery of the base 16 and shoulders 20 extending upwardly from the sidewalls 18. A spout 30 is integrally formed with the body 12 and extends upwardly from the shoulder 20, centrally of the container 10. The spout 30 has an internal passage 32 which is in fluid communication with the reservoir 14.

A restricted area in the spout 30 is defined by a pair of projections 34 formed on the internal wall 30*a* of the spout. The projections 34 are positioned at the juncture between the spout 30 and the shoulder 20. The spout, above the projections, gradually tapers inwardly towards its distal end. The projections 34 are shaped so that the diameter A of the passage 32 at the projections is less than the diameter B of the passage just downstream of the projections 34. The diameter C of the internal passage 32 at the distal end of the spout 30 may be greater than or less than the diameter A.

In the case of non-viscous liquids, it is preferred that the diameter A is approximately equal to between one-third (⅓) to one-half (½) of the diameter B and that the diameter C is approximately ten percent (10%) larger than the diameter A. In the case of viscous liquids or in cases where accurate delivery of the liquid is desired, it is desirable to dimension the spout 30 co that the diameter C is less than the diameter A. In this case, liquid will travel along the spout 30 with relatively higher velocity but due to the small volume of liquid in the spout as a result of the projections 34, the desired controlled liquid flow exiting the spout is achieved.

Before use, the spout 30 is typically deflated and the reservoir 14 holds all of the liquid in the container 10. The spout 30 which acts as a straw may be folded over one of the sidewalls 18 and attached to it with a small amount of adhesive. When it is desired to open the container 10, if the spout 30 is attached to a sidewall 18, it must be released from the sidewall and then the distal end of the spout 30 must be cut.

After this has been done, when it is desired to dispense liquid from the reservoir 14 and pressure i s applied to the body 12, the liquid in the reservoir flows into the passage 32 of the spout 30. The restricted area defined by the projections 34 represents a pressure increase zone while the area of the passage just downstream of the projections 34 represents a pressure drop zone. Liquid exiting the reservoir 14 and passing through the restricted area into the low pressure zone exits the container 10 with a pressure drop as compared to the pressure at the restricted area thereby giving an individual more control over the velocity of out-flowing liquid. The inward taper of the spout 30 towards the distal end results in an increase in pressure as liquid flows along the spout 30 after passing through the restricted area. This increase in pressure ensures that the spout 30 substantially fully inflates as liquid flows along the spout.

Figure 2:
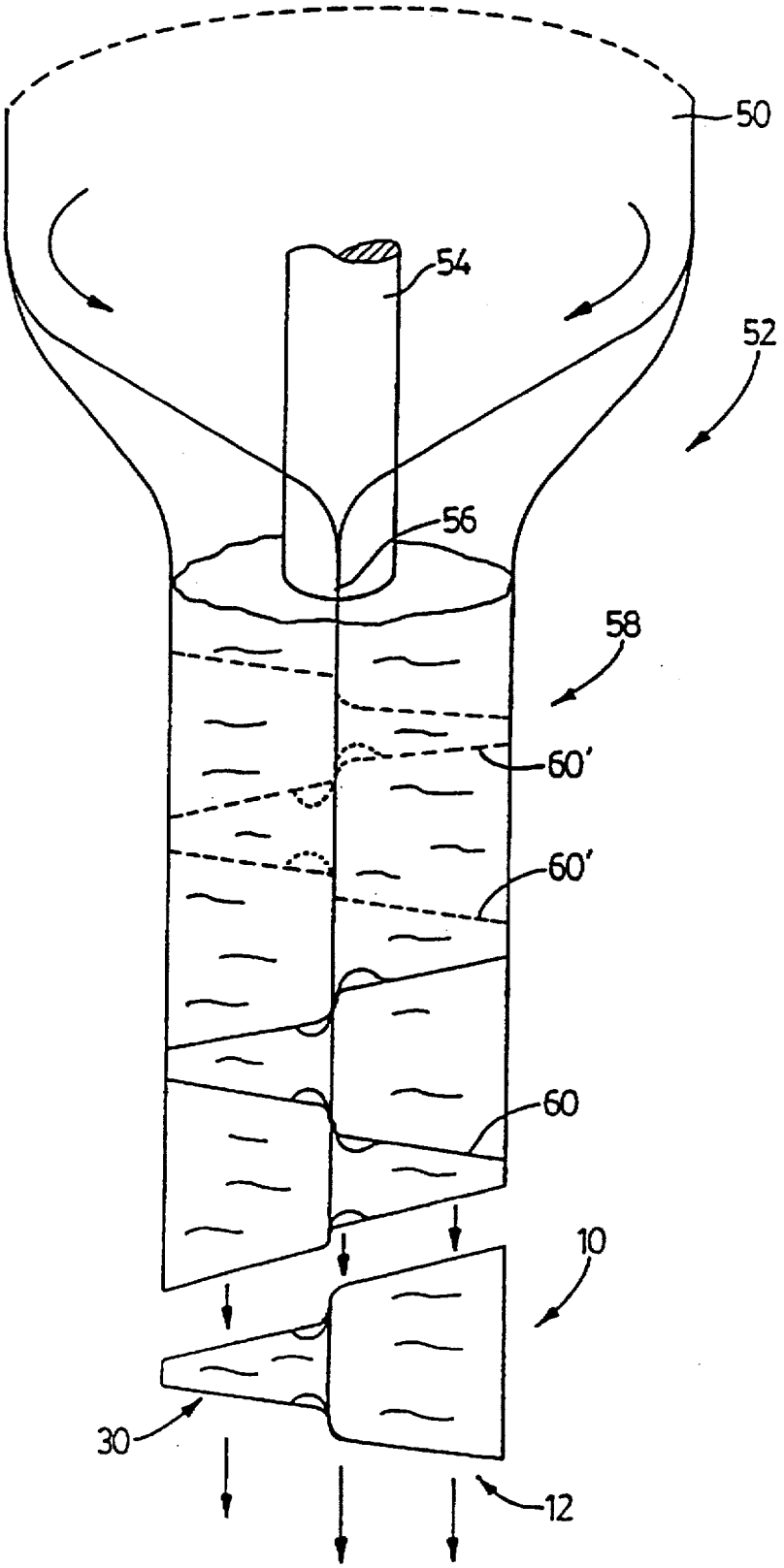
FIG. 2. is a view of a tube being filled with liquid and then partitioned to form liquid-filled containers which when made self-supporting will be of the type illustrated in FIGS. 1*a* and 1*b*.
Figure 3:
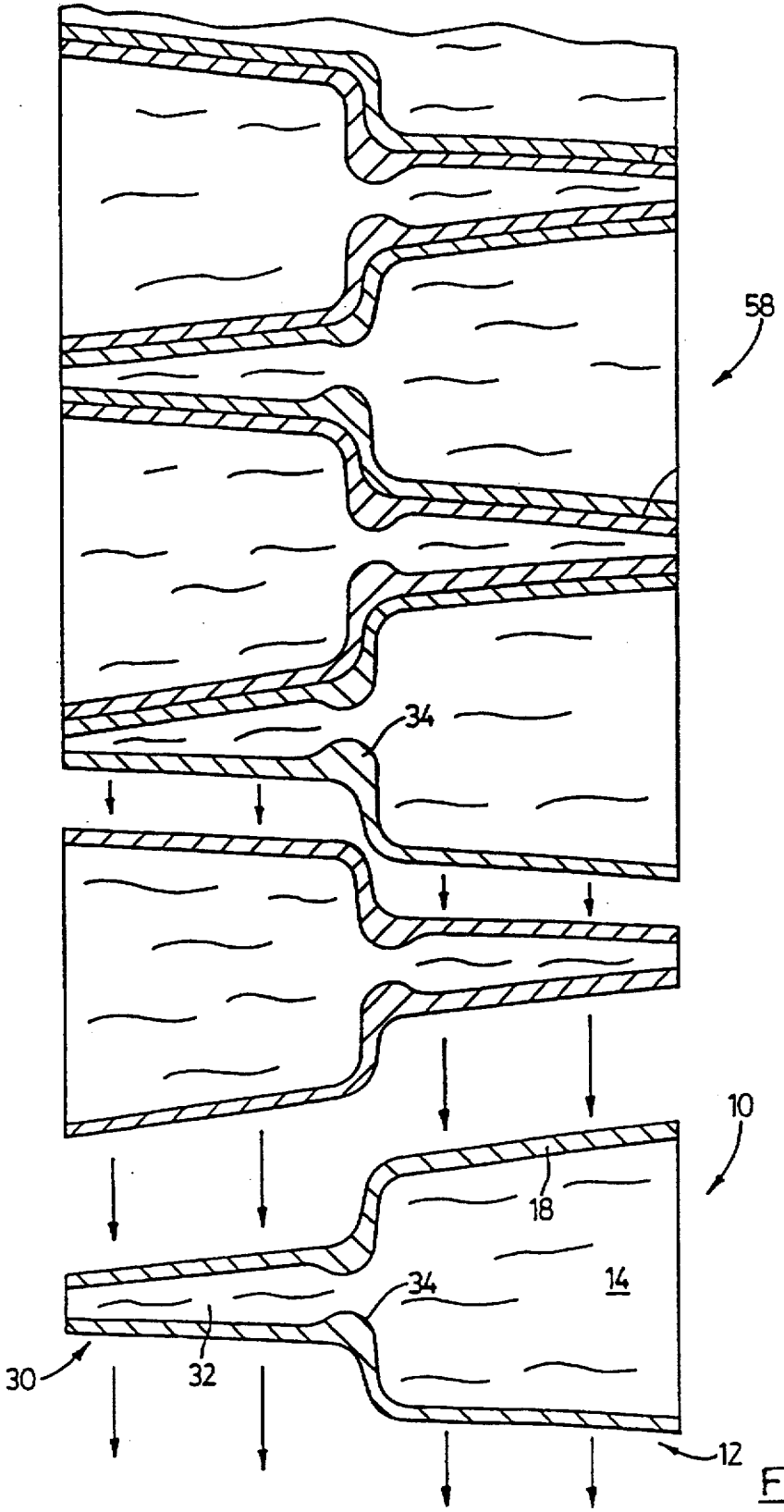
FIG. 3 is an enlarged cross-sectional view of a portion of FIG. 2.

Referring now to FIGS. 2 and 3, an apparatus to create and fill containers 10 from a plastic tube 50 is shown and is generally indicated by reference numeral 52. The apparatus 52 receives the plastic tube 50 and delivers it around a liquid delivery conduit 54. Below the liquid delivery conduit 54 is a heat sealing machine (not shown) to heat seal the tube 50 transversely. The heat seals 60 form seams which constitute the sides of a pair of adjacent containers 10.

Initially, the heat sealing machine forms a heat seal 60 at the bottom of the tube 50. Liquid to be held in the containers 10 is delivered to the tube by the liquid delivery conduit 54. As the tube 50 fills with liquid, the tube 50 is advanced towards the heat sealing machine so that successive heat seals 60 can be formed transversely across the tube 58. In FIG. 2, the dashed lines 60' represent the configuration of the heat seals to be formed as the tube 50 advances towards the heat sealing machine. It is preferred that the heat seals 60 are formed using a heat sealing knife which not only heat seals the tube 50 to define the sides of a pair of adjacent containers 10 but also cuts the tube 50 so that each liquid-filled container separates from the bottom of tube 50 as it is formed. The weight of the liquid-filled container of course assists the separation process.

In order to minimize waste during formation of the containers 10 from the tube 50 and to facilitate the formation of self-supporting containers 10 having generally rectangular parallelepiped bodies 12, the heat seals are configured such that the relative lengths of the spout 30 and body of each container 10 are made equal and such that the bodies 12 of the containers 10 are outwardly tapered.

During creation of the heat seals 60, the heat sealing process can be designed to form the projections 34 as each container is formed. Alternatively, the projections 34 may be formed in a secondary operation after the containers have been separated from the tube 50.

Figure 4C:
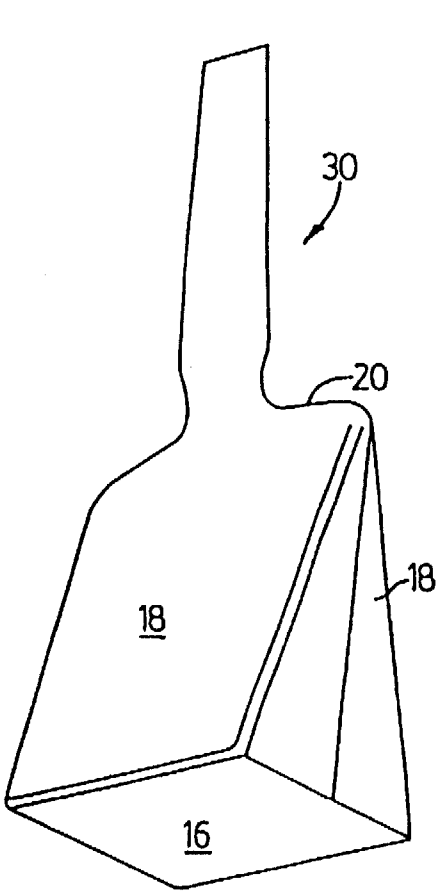
FIGS. 4*a*, 4*b* and 4*c* are perspective views showing the steps performed to make the container of FIGS. 1*a* and 1*b* self-supporting.
Figure 4B:
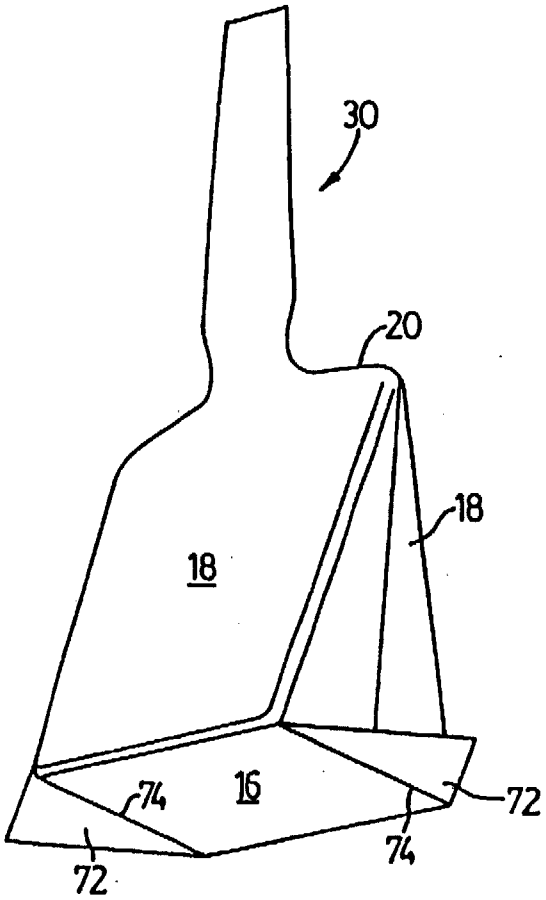
Figure 4A:
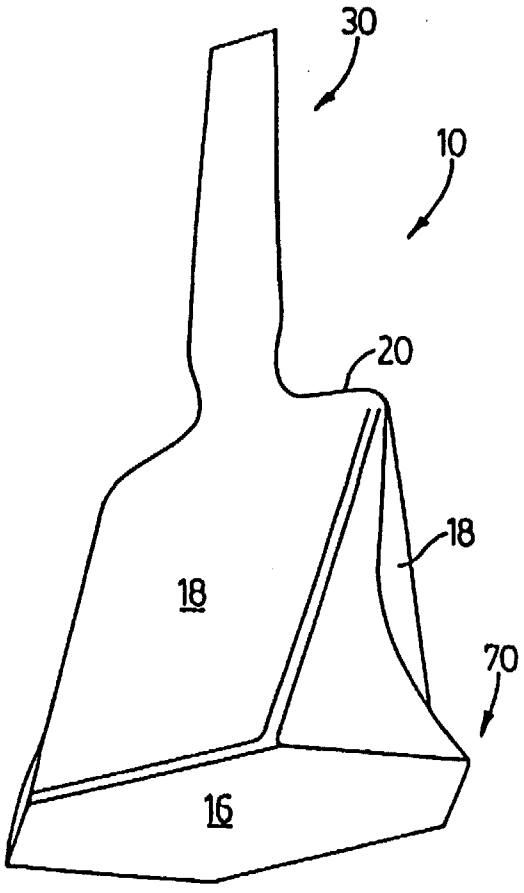

To make the containers 10 self-supporting after the containers have been filled with liquid and separated from the tube 50, opposed sidewalls 18 of the container are pushed inwardly and the bottom corners 70 of the body 12 are flattened and pinched to form flattened triangular portions 72. Heat seals 74 are then formed along the 9 pinch lines and the triangular portions 72 are separated from the body along the heat seals 74 to create the base 16. FIGS. 4*a* to 4*c* best illustrate the above steps. The outwardly tapering sides of the body which exist after the liquid-filled container has been separated from the tube 50, allow the container 10 to be made self-supporting while ensuring that the sidewalls 18 of the body 12 are generally vertical. If desired, the triangular portions need not be removed from the body but instead may be folded over to overlie the base and may be attached to the base by adhesive or other suitable means.

Because the containers are formed by transverse heat seals across the tube 50 after the tube has been filled with liquid, the present method of forming a liquid-filled container is particularly suited to aseptic packaging. Also, the transverse heat seals ensure that no thick seams are formed at the base of the containers which may result in unwanted leakage.

Although the process for creating the containers has been described as using a heat sealing knife to seal and separate each container from the end of the tube as it is formed, those of skill in the art will appreciate that a heat sealing machine may be used to form successive heat seals across the tube to partition the tube into a string of containers, each filled with liquid. In this case, as the containers 10 are formed and filled with liquid, they are separated one at a time from the bottom of the tube in a second operation. This second operation is performed by a cutting machine (not shown) which cuts along the heat seals 60 without affecting the integrity of the sides of the adjacent containers 10.

Although the containers 10 have been described as having spouts and bodies of equal length, the shape of the container and the relative lengths of the body and spout can of course be changed, although this will result in wasted material during the container formation process.

Figure 5:
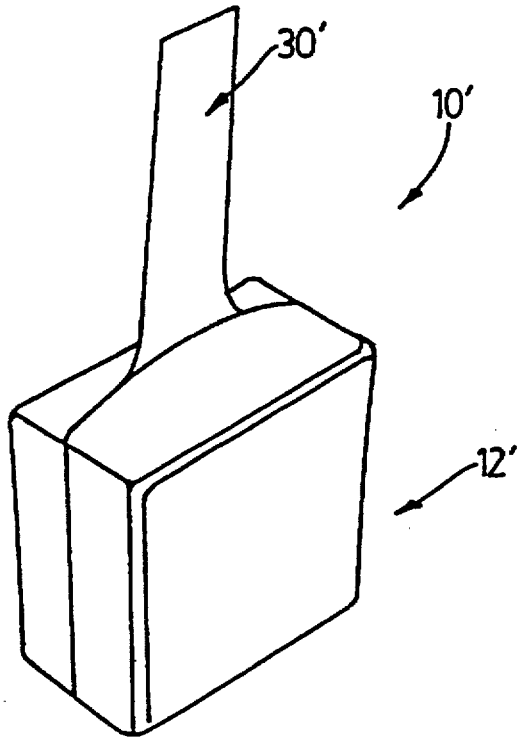
FIG. 5 is a perspective view of an alternative embodiment of a self-supporting container for liquids.
Figure 6:
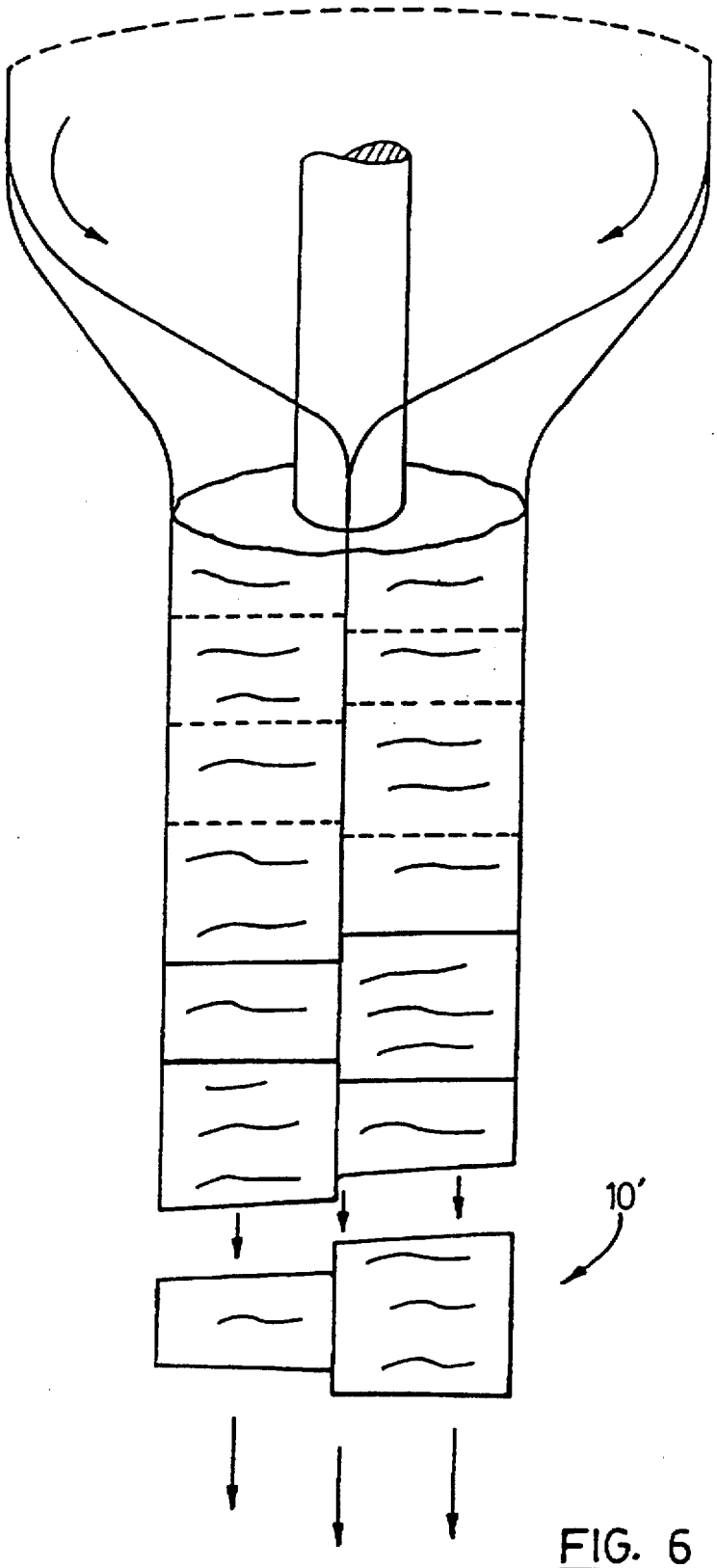
FIG. 6 is a view of a tube being filled with liquid and then partitioned to form containers which when made self-supporting will be of the type illustrated in FIG. 5.

Referring now to FIGS. 5 and 6, another embodiment of a self-supporting container 10' and method of making the same is shown. In this embodiment, the body 12' of the container more closely resembles a rectangular parallelepiped than that of the previous embodiment. This of course, allows the containers to be more closely packed and therefore require less packaging and shelf space.

To achieve this body design, during formation of the heat seals, the taper along the length of the spout 30' and the body 12' is removed. The taper along the spout is performed in a secondary operation. To make the container 10' self-supporting and to avoid inwardly tapering sidewalls, opposed sides of the body at their tops and bottoms are pushed inwardly and the corners of the sidewalls at the tops and bottoms are flattened and pinched to form triangular portions. Heat seals are than formed along the pinch lines and the triangular portions are removed from the body.

Figure 7:
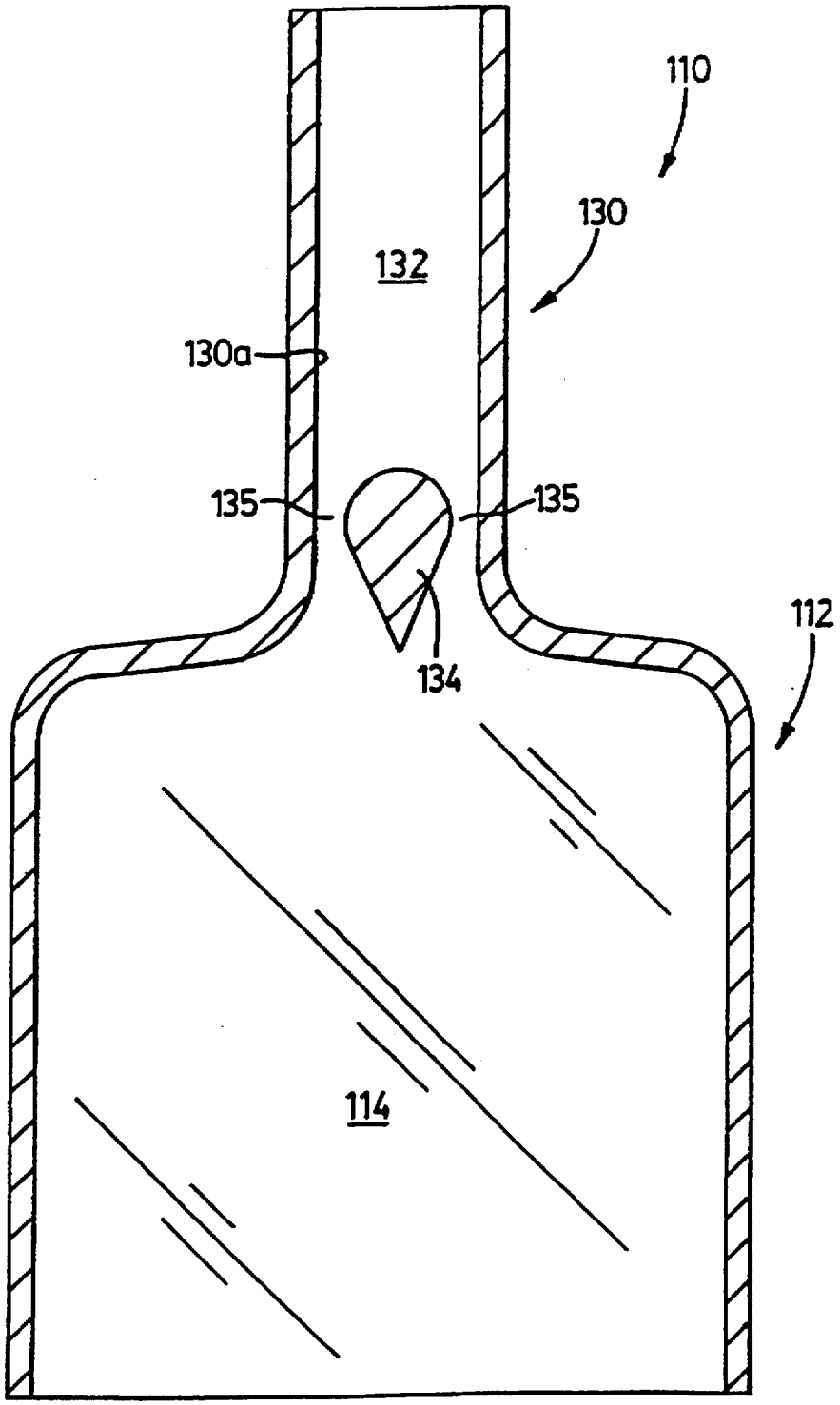
FIG. 7 is a cross-sectional view of yet another embodiment of a container for liquids.

Referring now to FIG. 7, yet another embodiment of a container for liquids is shown and is generally indicated by reference numeral 110. In this embodiment, like reference numerals will be used to indicate like components with a "100" added for clarity. In this embodiment, the restricted area in the passage 132 of the spout 130 is defined by an obstruction 134. The obstruction defines a pair of fluid flow paths 135 on opposite sides of the obstruction. The obstruction 134 resembles an inverted wing. Unlike the previous embodiment, the passage 132 has a generally constant diameter downstream of the obstruction 134.

Similar to the previous embodiment, when it is desired to dispense liquid from the reservoir 114 after the distal end of the spout 130 has been cut, pressure is applied to the body 112 causing liquid to flow from the reservoir into the spout 130. As liquid exits the reservoir 114, the liquid enters an increased pressure zone as it travels along flow paths 135. As the liquid passes by the obstruction, it immediately enters a low pressure zone to provide out-flowing liquid velocity control. The configuration of the obstruction 134 is such that drag is created immediately downstream of the obstruction. As a result, the drag helps to inflate the spout 130 obviating the need for the spout to be inwardly tapered.

As one of skill in the art will appreciate, the present invention provides advantages in that by reducing the pressure of liquid in the spout after it exits the reservoir, better out-flowing liquid velocity control is achieved while ensuring that the spout substantially fully inflates. It has been found that in the container disclosed in Applicant's U.S. Pat. No. 5,378,065, the contents of which are incorporated herein by reference, in some instances, the spout does not inflate when liquid passes through the restricted area into the spout. In this case, liquid entering the spout from the reservoir follows a path having a diameter basically the same as that of the restricted area. When this occurs, the desired pressure drop at the downstream side of the restriction does not occur.

Although the container 10 has been described as being self-supporting, it should be appreciated that the containers need not be made self-supporting. It should also be realized that variations and modifications may be made to the present invention without departing from the scope thereof as defined by the appended claims.

We claim:

1. A container for liquids formed of flexible plastic material comprising:

a body having an internal reservoir;

a tubular spout extending from said body and having an internal passage in fluid communication with said reservoir; and a constriction in said container adjacent the juncture between said spout and said body to create a low pressure zone in said passage downstream of said constriction as liquid flows from said reservoir into said passage;

wherein said passage has a decreasing cross-sectional area in a direction towards a distal end of said spout to cause said liquid to inflate said spout as liquid flows along said passage.

2. A container as defined in claim 1 wherein said container is formed from a unitary piece of plastic material.

3. A container as defined in claim 2 wherein said constriction is defined by at least one projection on an internal wall of said spout, said at least one projection extending into said passage.

4. A container as defined in claim 3 wherein said at least one projection is positioned at the juncture between said spout and said body.

5. A container as defined in claim 4 wherein said at least one projection is defined by a pair of diametrically opposed projections.

6. A container as defined in claim 1 wherein said cross-sectional area decreases generally continuously along the length of said passage and is defined by an inward tapering of said passage.

7. A container as defined in claim 6 wherein said passage tapers from said constriction to a distal end of said spout and wherein the diameter of said passage at said distal end is approximately 10 percent greater than the diameter of said passage at said constriction.

8. A container as defined in claim 7 wherein said passage at said constriction is approximately equal to between one-third to one-half of the diameter of said passage immediately downstream of said constriction.

9. A container as defined in claim 1 wherein said constriction and means to inflate are constituted by an obstruction extending across said passage and defining fluid flow paths on either side thereof, said obstruction having a configuration resembling an inverted wing.

10. A container as defined in claim 1 wherein said body is self-supporting.

11. A container as defined in claim 6 wherein said constriction is defined by at least one projection on an internal passage of said spout, said at least one projection extending into said passage.

12. A container as defined in claim 11 wherein said at least one projection includes a pair of diametrically opposed projections extending into said passage, said projections being positioned at the juncture between said spout and said body.

13. A container for fluids formed of flexible plastic material comprising:

a body having an internal reservoir;

a tubular spout extending from said body and having an internal passage in fluid communication with said reservoir; and a constriction in said passage to create a low pressure zone in said passage downstream of said constriction as fluid flows from said reservoir into said passage, wherein said passage has a generally continuously decreasing cross-sectional area in a direction towards a distal end of said spout to cause said fluid to inflate said spout as fluid flows along said passage, the diameter of said passage at said distal end being approximately 10 percent greater than the diameter of said passage at said constriction.

14. A container as defined in claim 13 wherein said passage at said constriction is approximately equal to between one-third to one-half of the diameter of said passage immediately downstream of said constriction.

15. A container as defined in claim 14 wherein said constriction is defined by at least one projection on an internal wall of said spout, said at least one projection extending into said passage.

16. A container as defined in claim 15 wherein said at least one projection includes a pair of diametrically opposed projections extending into said passage, said projections being positioned at the juncture between said spout and said body.

17. A container as defined in claim 13 wherein said body is self-supporting.

18. A container for fluids formed of flexible plastic material comprising:

a body having an internal reservoir;

a tubular spout extending from said body and having an internal passage in fluid communication with said reservoir; and a constriction in said passage to create a low pressure zone in said passage downstream of said constriction as fluid flows from said reservoir into said passage, said constriction being constituted by an obstruction in said passage and defining fluid flow paths on either side thereof, said obstruction having a configuration resembling an inverted wing.

19. A container as defined in claim 18 wherein said body is self-supporting.

20. A container for fluids formed of flexible plastic material comprising:

a body having an internal reservoir;

a tubular spout extending generally centrally from said body and having an internal passage in fluid communication with said reservoir; and a constriction in said container adjacent the juncture between said spout and said body to create a low pressure zone in said passage downstream of said constriction as fluid flows from said reservoir into said passage, said passage tapering inwardly along its length in a direction towards a distal end of said spout.

21. A container as defined in claim 20 wherein said constriction is defined by a pair of diametrically opposed projections on an internal wall of said spout, said projections extending into said passage at the juncture between said spout and said body.

22. A container as defined in claim 21 wherein said container is formed from a unitary piece of plastic material.

23. A container as defined in claim 22 wherein the diameter of said passage at said distal end is approximately 10 percent greater than the diameter of said passage at said constriction.

24. A container as defined in claim 23 wherein said passage at said constriction is approximately equal to between one-third to one-half of the diameter of said passage immediately downstream of said constriction.

25. A container as defined in claim 24 wherein said body is self-supporting.

* * * * *